US005570164A

United States Patent [19]

Yamamoto et al.

[11] Patent Number: 5,570,164

[45] Date of Patent: Oct. 29, 1996

[54] TONER SCRAPER FOR A DEVELOPING APPARATUS

[75] Inventors: Mikio Yamamoto; Hidekiyo Tachibana; Masashi Kajimoto; Yutaka Toyoda, all of Kanagawa, Japan

[73] Assignee: Fuji Xerox Co., Ltd., Tokyo, Japan

[21] Appl. No.: 222,814

[22] Filed: Apr. 5, 1994

[30] Foreign Application Priority Data

Apr. 6, 1993 [JP] Japan ..... 5-079467

[51] Int. Cl.[6] ..... G03G 15/06

[52] U.S. Cl. ..... 355/245; 15/256.51; 355/259

[58] Field of Search ..... 355/245, 259, 355/269, 270, 215, 299; 118/647, 653, 656, 661, 261, 652; 15/256.51–256.53

[56] References Cited

U.S. PATENT DOCUMENTS

| | | | |
|---|---|---|---|
| 4,743,937 | 5/1988 | Martin | 118/656 X |
| 4,885,223 | 12/1989 | Enoki et al. | 118/656 X |
| 4,935,784 | 6/1990 | Shigehiro et al. | 355/245 X |
| 4,958,193 | 9/1990 | Nojima et al. | 355/259 |
| 5,138,382 | 8/1992 | Van Duser et al. | 355/215 |
| 5,145,724 | 9/1992 | Yanai et al. | 15/256.51 X |
| 5,177,537 | 1/1993 | Okano et al. | 355/259 |
| 5,191,170 | 3/1993 | Yoshida et al. | 355/245 X |
| 5,247,333 | 9/1993 | Yamamoto et al. | 355/245 |
| 5,387,963 | 2/1995 | Kajimoto et al. | 355/215 |

FOREIGN PATENT DOCUMENTS

| | | |
|---|---|---|
| 47-13088 | 7/1972 | Japan . |
| 60-2967 | 1/1985 | Japan . |
| 62-251771 | 11/1987 | Japan . |
| 1-49945 | 10/1989 | Japan . |
| 4-37778 | 2/1992 | Japan . |
| 4-100075 | 4/1992 | Japan . |

*Primary Examiner*—Matthew S. Smith

*Attorney, Agent, or Firm*—Finnegan, Henderson, Farabow, Garrett & Dunner, L.L.P.

[57] ABSTRACT

A toner scraper includes a rubber member which is to be contacted with the rotation body of a developing device, and a plate spring member for elastically supporting the rubber member which is fixed to the front end portion of the plate spring member, wherein at least an edge portion of the rubber member which is in the side of a portion of the plate spring member at which the plate spring member is supported is contacted with the surface of the rotation body.

Such a toner scraper which is contacted with a roll or belt-like rotation body disposed as a component of a developing device and which scrapes off a toner adhering to the surface of the rotation body is configured so that the scraper can scrape off the toner uniformly and stably even when the contact pressure is relatively low, the scraper can be produced at a low cost, and the scraper has a simple structure.

1 Claim, 10 Drawing Sheets

TONER SCRAPER FOR A DEVELOPING APPARATUS

BACKGROUND OF THE INVENTION

1. Field of the Invention

This invention relates to a toner scraper which is used for scraping off a toner adhering to a roll or belt-like rotation body. Such a rotation body is disposed as a component of a developing device which develops an electrostatic latent image formed on a latent image holder with using the toner.

2. Description of the Related Art

As an example of a developing device which develops an electrostatic latent image formed on a latent image holder such as a photosensitive drum with using a toner, a one-component developing device is known (for example, Japanese Patent Unexamined Publications Nos. SHO47-13088, and SHO62-251771). In such a one-component developing device, as shown in FIG. 7, a toner 5 supplied to a rotating roll-like toner carrier 41 is formed into a thin layer by a layer forming member 6 which is compressedly contacted with the toner carrier 41. Thereafter, the toner layer is transported to a development area which opposes a latent image holder 7, and the toner is caused to adhere to a latent image 8 formed on the latent image holder 7, thereby developing the latent image.

In such a developing device, generally, it is important to stably supply a toner to the toner carrier, to stably form a layer of the toner supplied to the carrier, and to cause the toner in the form of a layer to adhere with fidelity to the electrostatic latent image. Also, it is important to prevent the image hysteresis (development ghost) phenomenon from occurring on the toner carrier.

As shown in FIG. 7, therefore, Japanese Patent Unexamined Publication No. HEI4-100075 discloses developing device in which applying a bias voltage from a power source 10 across the toner carrier 41 and a roll-like toner supply member 42 for supplying a toner to the toner carrier 41, so that the toner is stably supplied to the toner carrier. Further, when an excess amount of a toner adheres to the toner supply member 42, the ability of supplying the toner to the carrier is lowered. In order to prevent the toner supply ability from being lowered, Japanese Patent Unexamined Publication No. HEI4-37778 discloses a developing device which is provided with a toner scraper 100 that is contacted with the surface of the toner supply member 42.

Japanese Patent Unexamined Publication No. SHO60-002967 discloses to use a roll-like layer forming member which rotates while contacting with the toner carrier in order to stably form a thin layer of a toner on the toner carrier. Also when an excess amount of a toner adheres to the surface of the roll-like layer forming member, it is impossible to stably conduct the layer formation. Accordingly, the developing device is provided with a toner scraper which is contacted with the surface of the roll-like layer forming member.

Moreover, Japanese Patent Unexamined Publication No. SHO62-251771 discloses a toner scraper which is directly contacted with the toner carrier in order to prevent the image hysteresis phenomenon from occurring. Japanese Patent Examined Publication No. HEI1-49945 discloses a toner peeling roll which is rotatively contacted with the toner carrier and for disposing a toner scraper for removing a toner adhering to the peeling roll.

The image hysteresis is a phenomenon in which the thickness and toner electrification of a toner thin layer in an area where is previously used in the development (developing area) are different from those in another area where is not previously used in the development (nondeveloping area), and, when developments of the same image are continuously conducted and a development of a different image is then conducted, the development of the different image is affected by the previous developments (that is, the amount of a toner on the area of the toner carrier which corresponds to the nondeveloping area of the previous development is smaller that on the area which corresponds to the developing area of the previous development). As a result of the image hysteresis, in an obtained image, the density of the image portion corresponding to the nondeveloping area of the previous development is different from that of the image portion corresponding to the developing area (the image portion corresponding to the nondeveloping area is lower than that of the image portion corresponding to the developing area), thereby making the image density uneven.

In such a one-component developing device, or the like, a known toner scraper for scraping off a toner from the surface of a rotation body such as a toner carrier, a toner supply roll, a roll-like layer forming member, or a peeling roll has a configuration such as shown in FIGS. 8(*a*) or (*b*). In the configuration shown in FIG. 8(*a*), an elastic member 101 such as a rubber plate, a stainless steel plate, or a polyester film is supported and fixed at one end portion, and under this state the elastic member is contacted with the surface of a rotation body. In the configuration shown in FIG. 8(*b*), the elastic member 101 is attached in a rigid holder 102 for fixation and support in such a manner that the front end of the elastic member protrudes from the holder. However, such a known toner scraper has the following problems.

In order to enhance the effect of scraping off a toner, generally, the front edge portion of a scraper is contacted with the surface of a rotation body with a predetermined inclination angle. However, it is difficult that the toner scraper is uniformly contacted with the rotation body along the longitudinal direction of the rotation body.

In the realization of the uniform contact, the linearity of the edge portion of the toner scraper along the longitudinal direction, the working accuracy of the edge portion, and the positional accuracy of the contact between the edge portion and the rotation body play important roles. However, it is difficult for such a conventional toner scraper to accomplish these requirements. If a toner scraper is constructed or installed in a high accuracy, the cost of the toner scraper is increased. Accordingly, a toner scraper made of an elastic material is usually contacted with the whole area of the rotation body at a relatively high contact pressure (about 60 gf/cm or higher), so that the uniform contact is attained. In a toner scraper composed of a rubber member, particularly, it is often that the forming accuracy of the edge portion is difficult to improve, and the linearity thereof is liable to be impaired during a process of attaching the rubber member. Therefore, the contact pressure of a toner scraper composed of a rubber member must be set to be a higher value (about 80 gf/cm or higher) than that of a toner scraper composed of a member of another kind.

However, a high contact pressure produces further problems as described below.

If a plate spring member made of a metal such as a stainless steel plate is used as a toner scraper, a high stress concentrates at an edge portion contacting with a rotation body. In this case, therefore, the surface of the rotation body contacting with the edge portion is liable to be damaged. Moreover, since a toner is deteriorated in a short period by a stress which is applied on the toner during the scraping process, the scraped toner cannot be returned to the developer to be reused. In addition, if a film member of a plastic such as polyester is used as a toner scraper, the durability of the film member itself is low. In this case, therefore, the toner scraper is extremely abraded as a result of a long period use to be difficult to be used. Also in the case of a rubber member, since the front edge portion is contacted with the rotation body at a high pressure, the frictional resistance is high so that the driving torque of the rotation body is increased. When the toner scraper is used for a long period, this high frictional resistance causes the toner scraper to be easily abraded, thereby deteriorating the toner.

Moreover, in the case where a toner which is scraped off by a toner scraper under such a high contact pressure is returned to the developer to be reused, particularly when the toner is a polyester toner having a low glass transition temperature, the toner scraper applies a stress to the toner to deteriorate it uniformly in a short period use. This arises a problem in that the layer forming member cannot stably conduct the layer formation and hence a layer disturbance is generated.

SUMMARY OF THE INVENTION

It is an object of the invention to provide a toner scraper for a developing device which can be contacted with a rotation body uniformly and stably even when the contact pressure is relatively low, which can be produced at a low cost and has a simple structure.

The toner scraper of the invention is a toner scraper for a developing device which is to be contacted with a roll or belt-like rotation body disposed as a component of the developing device, thereby scraping off a toner adhering to a surface of the rotation body, and characterized in that the toner scraper comprises: a rubber member which is to be contacted with the rotation body; and a plate spring member for elastically supporting the rubber member which is fixed to a front end portion of the plate spring member, and at least an edge portion of the rubber member which is in the side of a portion of the plate spring member at which the plate spring member is supported is contacted with the surface of the rotation body.

In the present invention, the toner scraper member may include a rubber member such as urethane ribber, EPDM rubber or the like which at least the supporting end side is formed into an edge-like shape. The rubber member may have a thickness of about 0.5 to 5.0 mm, and a rubber hardness of 30 to 70 deg., preferably about 50 deg. The rubber member having a rubber hardness within this range is used so that the abrasion resistance of the edge portion which is to be contacted with the rotation body can attain a minimum requirement level, the nip width between the toner scraper and the rotation body can attain a substantial degree, and a stress applied to the toner can be reduced in level.

As the plate spring member constituting the toner scraper, a plate spring material which has a thickness of about 0.05 to 0.20 mm, preferably 0.08 to 0.10 mm and which is made of stainless steel, phosphor bronze, or the like may be used.

As shown in FIG. 1, the toner scraper 1 has a configuration in which the rubber member 2 is fixed to the front end portion of the plate spring member 3 by adequate adhesion member, and is used while the other end of the plate spring member is supported and fixed to a predetermined location within the developing device.

When the toner scraper 1 is to be used, the toner scraper 1 is disposed in such a manner that, as shown in FIG. 2, the edge portion 2*a* of the rubber member 2 in the side of the portion of the plate spring member 3 at which the plate spring member is supported is directed to the upstream side of the rotation of the rotation body 4, and contacted with the surface of the rotation body 4. If the rubber member 2 is contacted with the rotation body 4 at the top edge portion 2*b* in the side of the top end of plate spring member 3 or at a portion other than the edge portions, the toner scraper may fail to scrape a toner adhering onto the rotation body 4 therefrom instead of forming a toner thin film. In order to surely conduct the toner scraping, moreover, it is required to increase the contact pressure against the rotation body.

The toner scraper is used while being contacted with the surface of the rotation body at a contact pressure of 5 to 50 gf/cm, preferably 20 to 40 gf/cm. When the contact pressure exceeds 50 gf/cm, the toner is subjected to a stress during the scraping process. This produces a problem in that a charge control agent is buried in toner particles in a long period use and the charging property of the toner is lowered, thereby causing the toner to fall from the toner carrier. In contrast, when the contact pressure is lower than 5 gf/cm, it is difficult for the toner scraper to uniformly contact with the rotation body.

The toner which is scraped off by the toner scraper may be returned to the developer. This allows the toner to be reused so that the toner is prevented from being wasted, thereby achieving an efficient use of the toner.

Usually, the toner scraper may be used in a developing device which uses a magnetic or non-magnetic one-component developer, namely a device in which the development is conducted under a state where only a toner is adhered to a toner carrier. In accordance with requirements, the toner scraper may be used in a developing device which uses a color toner, a capsule toner, a liquid developer or the like.

The toner scraper is supported by the plate spring member so as to be easy to attain the uniform contact pressure and possible to uniformly contact with the rotation body even if the contact pressure is relatively low. Since the rubber member is used as a member which is to be contacted with the rotation body, it is possible to eliminate the possibility of damaging the surface of the rotation body. Moreover, the rubber member is resistant to abrasion and applies a small stress to a toner.

According to the uniformness of the contact pressure due to the plate spring member, and the low stress applied to a toner by the rubber member, the toner scraper can stably conduct the toner scraping for a long period in which toner deterioration is very small, even when the contact pressure is relatively low.

PREFERRED EMBODIMENTS OF THE INVENTION

Hereinafter, embodiments of the invention will be described as follows accompanying with the drawings.

First, a developing device to which the toner scraper of the invention is to be applied will be described in detail.

Figure 1:
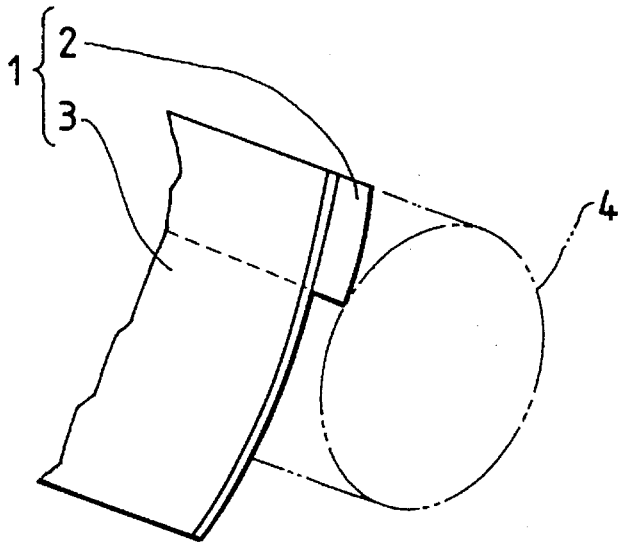
FIG. 1 is a perspective view showing an example of the toner scraper of the present invention.
Figure 2:
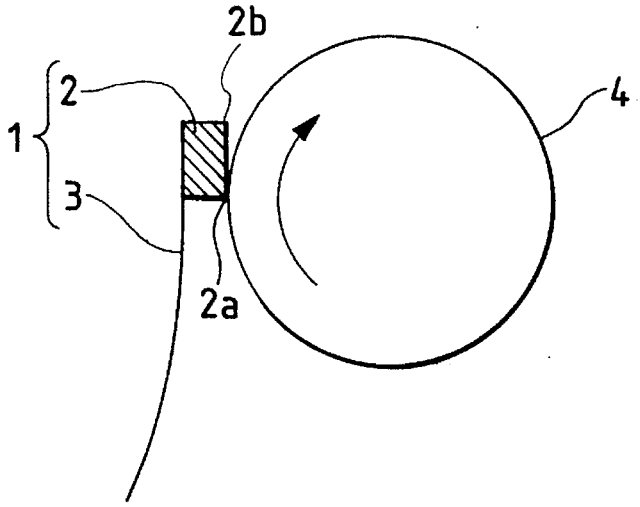
FIG. 2 is a view illustrating a contact state between the toner scraper of the present invention and a rotation body.
Figure 3:
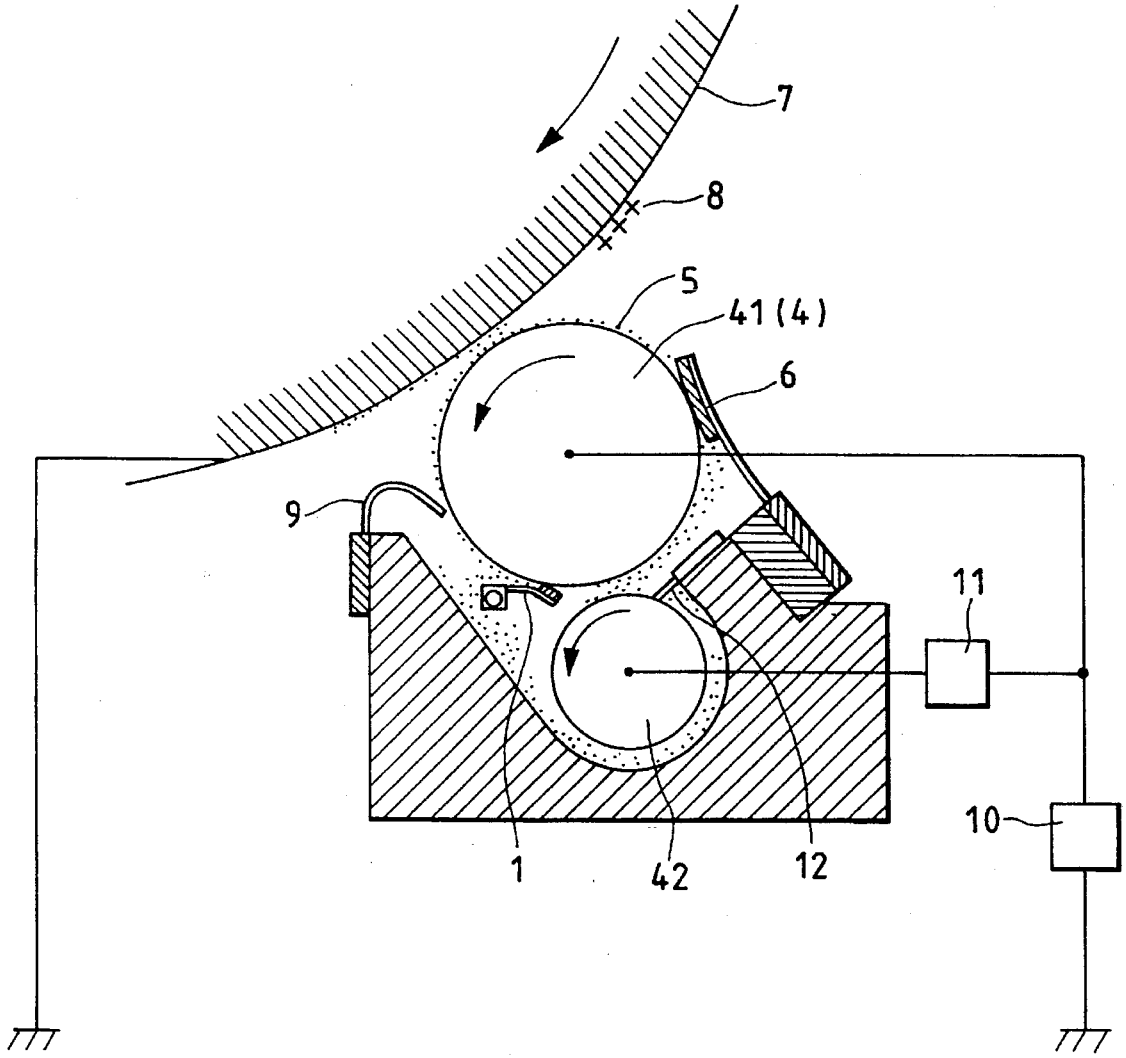
FIG. 3 is a schematic section view showing an embodiment of a developing device to which the toner scraper of the invention is applied.

FIG. 3 shows the whole configuration of a nonmagnetic one-component developing device in which the toner scraper of the invention is applied to a roll-like toner carrier. In the figure, reference numeral 1 designates a toner scraper, 5 designates a nonmagnetic one-component toner, 41 designates a toner carrier, 42 designates a toner supply member for supplying the toner 5 to the toner carrier 41, 6 designates a blade-like layer forming member, 7 designates an electrostatic latent image holder, 8 designates an electrostatic latent image, and 9 designates a seal member.

The toner 5 may be produced by dispersing a pigment such as carbon, and a polarity control agent such as a metallized azo dye into a thermoplastic resin such as a styrene resin, an acrylic resin, or a polyester resin, pulverizing and classifying to granulate into a particle diameter of 5 to 20 μm, and adding a charge control agent to the surface. A preferable charge control agent is silica, alumina, titanium, or the like which undergoes a hydrophobic process and which is in the form of fine particles having a diameter of 0.1 μm or less. Preferably, the charge control agent is hydrophobic silica.

The toner carrier 41 is a roll of 5 to 40 mm in diameter. For example, the roll-like toner carrier 41 is structured by cutting a round bar or pipe of aluminum or stainless steel into a predetermined length, and conducting a machining process or a chemical corrosion process such as sand blasting, liquid honing, or emery polishing on the circumferential surface to obtain a surface roughness of Ra=about 0.1 to 1.0 μm. Alternatively, the toner carrier may be structured by cutting a round bar or pipe of aluminum or stainless steel, forming a layer of a semiconductor such as a phenol resin on the circumferential surface, and conducting a mechanical polishing process such as emery polishing on the surface to obtain a surface roughness of Ra=about 0.1 to 1.0 μm, preferably Ra=about 0.2 to 0.4 μm. An aluminum roll which is conducted a mechanical polishing process and anodization may be used as the carrier. If the toner carrier 41 is provided with a semiconductive layer, the volume resistivity of the surface layer of the carrier in the thickness direction is preferably set to be about $10^5$ to $10^{12}$ Ωcm. The toner carrier 41 is rotated at a speed of rotation of 100 to 300 rpm.

A bias voltage for development is applied from a power source 10 to the toner carrier 41. Generally, the bias voltage is an AC bias voltage (frequency: 1 to 5 kHz) of 1,000 to 4,000 $V_{PP}$ to which a DC voltage of −50 to −400 V is superposed, and preferably an AC bias voltage having a peak value $V_{peak}$ which is in the range of 4 to 7 V/μm when divided by the gap between the toner carrier 41 and the latent image holder 7, and a frequency of 2.5 to 4.0 kHz.

The layer forming member 6 has a configuration wherein Si rubber or EPDM rubber is adhered by vulcanizing to a stainless steel plate spring of a thickness of about 0.03 to 0.3 mm. The layer forming member 6 is contacted with the toner carrier 41 at a pressure of about 20 to 200 gf/cm. The toner 5 supplied by the layer forming member 6 to the toner carrier 41 is formed into a thin layer of about 5 to 30 μm and provided with a charge of about 2 to 20 μC/g.

As the toner supply member 42, an aluminum or stainless steel pipe of 10 to 20 mm in diameter and having a thickness of 1 to 4 mm may be used. A plurality of openings are formed on the peripheral face of the pipe. The toner supply member 42 is disposed so as to oppose the toner carrier 41 with a gap of about 0.5 to 2.0 mm, and rotated at a peripheral speed which is about 1 to 5 times that of the carrier 41. A bias voltage for supplying the toner is applied from a power source 11 to the toner supply member 42. The bias voltage is a DC voltage of about 200 to 1,000 V so that the supply member 42 has the same polarity as that of the toner 5. In order to prevent the toner from unnecessarily adhering to the surface of the toner supply member 42, a film member 12 of plastic or the like and of about 50 to 500 μm thickness is contacted with the surface.

As the latent image holder 7, generally, an Se photosensitive material or an organic photosensitive material is used. The holder 7 opposes the toner carrier 41 with being separated therefrom by a gap of about 100 to 400 μm, preferably about 150 to 300 μm.

In the thus configured developing device, the development is conducted in the following manner.

The toner 5 is transported from a toner storage box (not shown) in the outside of the developing device, to the inside of the developing device, and then supplied from the toner supply member 42 to the toner carrier 41 by an electric field which is produced between the supply member 42 and the carrier 41 by the toner supply bias voltage. Thereafter, the layer forming member 6 supplies a sufficient amount of charge to the toner, and forms the toner into a thin layer. The toner 5 layered on the carrier 41 is transferred to the electrostatic latent image 8 held on the latent image holder 7, by the development bias voltage, whereby the latent image 8 is developed.

At the end of the development, an area (developing area) wherein the toner 5 is consumed to develop the electrostatic latent image 8, and an area (nondeveloping area) wherein the toner 5 is not consumed appear on the toner carrier 41.

The developing device is provided with the toner scraper 1 which is contacted with the toner carrier 41 after passing through the development area. Therefore, the toner remaining on the toner carrier 41 after passing through the development area is thoroughly scraped off by the toner scraper 1 so that there exists entirely no toner on the surface of the toner carrier 41. Consequently, the image hysteresis phenomenon is prevented from occurring in the subsequent development. The toner which has been scraped off by the toner scraper 1 is returned into the developing device and reused in the development.

Next, the case where the developing device is not provided with the toner scraper 1 which is contacted with the toner carrier 41 after passing through the development area will be described.

First, the toner 5 is newly supplied from the supply member 42 to the toner carrier 41 while both the above-mentioned developing area and nondeveloping area remain to be formed on the toner carrier 41, and the next development process is then started. In the nondeveloping area, therefore, a thin layer of the once formed toner 5 which has been formed passes again under the layer forming member 6. Particularly in a portion where the nondeveloping area continues for some distance, the same toner thin layer repeatedly passes under the layer forming member 6 without being newly supplied with the toner 5 from the supply member 42.

The thickness of the toner layer on the toner carrier 41 under this state was measured with the result that the thickness of the layer of the new toner 5 in the developing area was greater than that of the toner layer in the nondeveloping area by several microns. The charge amount of the new toner 5 in the developing area was smaller than that in the nondeveloping area by several microcoulombs per gram. The toner 5 in the developing area exerted a greater adhesion force on the carrier 41 than that exerted by the toner in the developing area, so as to be different from each other in the jumping property with respect to the electrostatic latent image 8 in the development area.

Figure 10A:
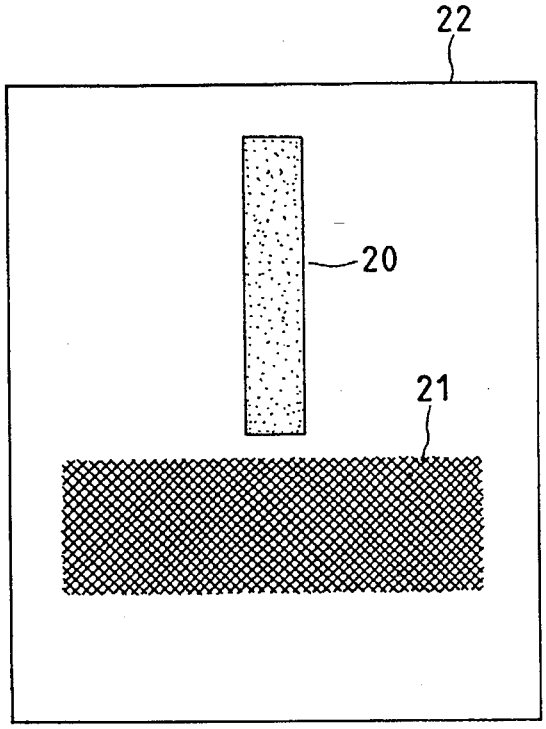
FIGS. 10(*a*) and 10(*b*) are plan views showing a print sample for illustrating the image hysteresis phenomenon.
Figure 10B:
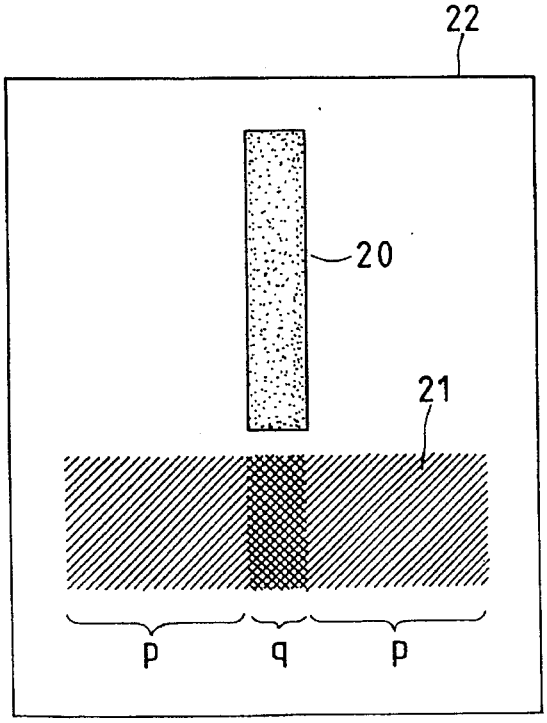

In an image (print sample) which is obtained as a result of the above-mentioned developing process, the image hysteresis phenomenon occurs in the manner as shown in, for example, FIG. 10.

An A4-size original 22 which, as shown in FIG. 10(*a*), has a rectangular solid image 20 of 3×10 cm, and a rectangular dot image 21 of 15×5 cm and an area rate of 50% was copied. In the resulting print image, as shown in FIG. 10(*b*), the copy density of regions p of the dot image 21 which follow the nonimage area of the solid image 20 is slightly lower than that of a region q of the dot image 21 which follows the image area q of the solid image 20.

It is supposed that this phenomenon is caused by the following reason: The toner 5 on the toner carrier 41 in the nondeveloping area flies to the electrostatic latent image 8, more hardly than the toner in the developing area. Since the charging property of the toner 5 on the toner carrier 41 in the nondeveloping area is slightly higher than that of the toner in the developing area, the amount of the toner in the nondeveloping area which is used for neutralizing charges of the latent image of the dot image is smaller than that in the developing area.

The image hysteresis phenomenon can be prevented from occurring by disposing the toner scraper 1 which is contacted with the toner carrier 41. The image hysteresis phenomenon can be prevented from occurring also by disposing a toner peeling roll 43 which is rotatively contacted with the toner carrier 41 as shown in FIG. 4.

The peeling roll 43 has a configuration in which the surface of an aluminum or stainless steel round bar of about 3 to 15 mmϕ is covered by conductive silicone rubber or EPDM rubber in the thickness of 0.5 to 5.0 mm so that the volume resistivity of the conductive rubber layer is set to be $10^3$ to $10^9$ Ωcm. The peeling roll 43 is rotated so that its surface moves in the same direction as that of the toner carrier 41, and at a peripheral speed which is 0.5 to 1.5 times, preferably 0.9 to 1.1 times that of the toner carrier 41. An AC voltage to which a DC voltage is superposed or a DC having a polarity opposite to that of the toner 5 is applied as a bias voltage from a power source 13 to the peeling roll 43.

Figure 4:
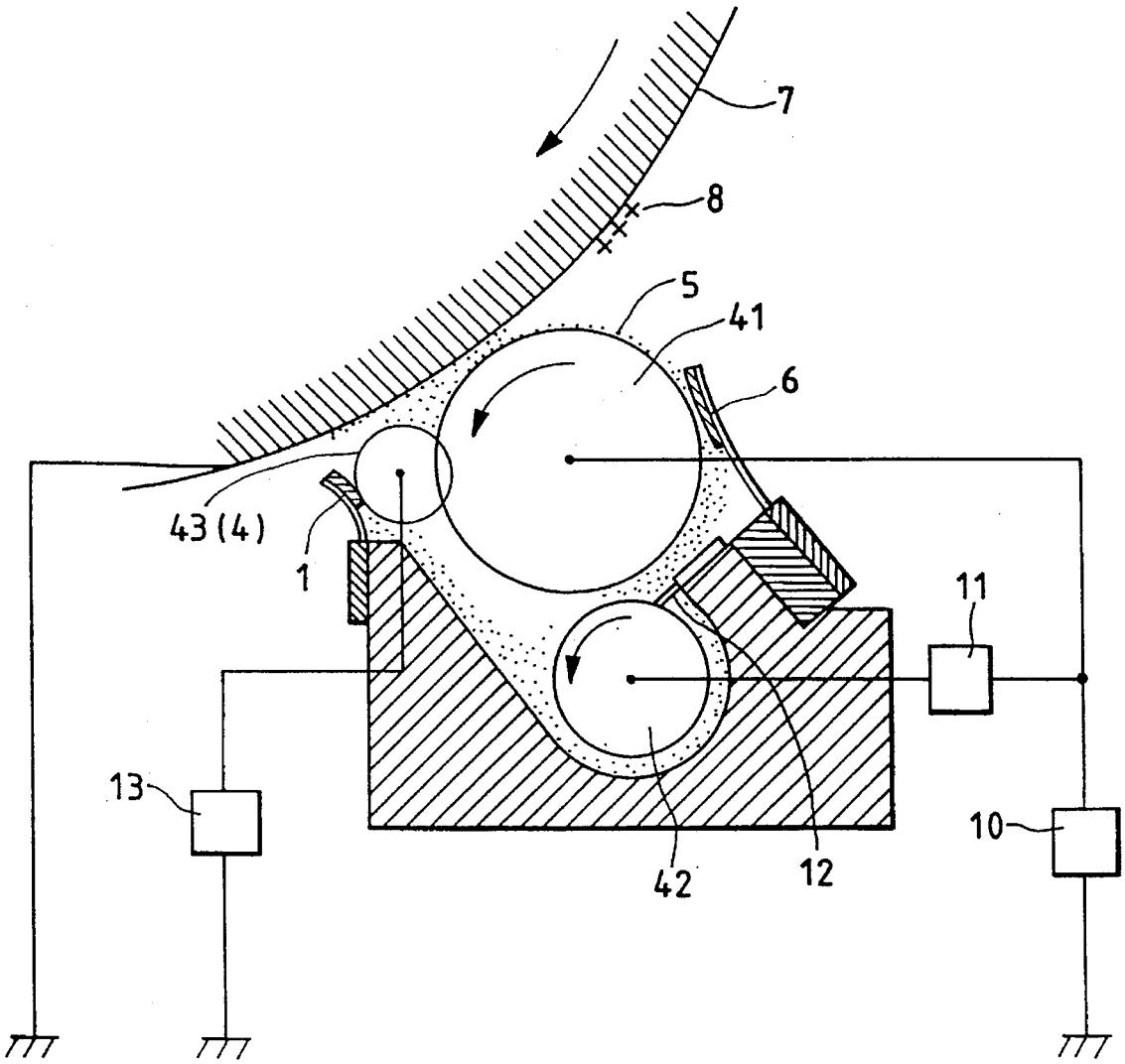
FIG. 4 is a schematic section view showing a developing device relating to Example 1.

In the case where the peeling roll 43 is disposed, as shown in FIG. 4, the toner scraper 1 is disposed so as to be contacted with the peeling roll 43. The contact pressure of the toner scraper 1 exerted on the peeling roll 43 is 5 to 50 gf/cm, preferably 10 to 30 gf/cm. The toner which is scraped off by the toner scraper 1 is returned into the developing device and reused in the development.

Figure 5:
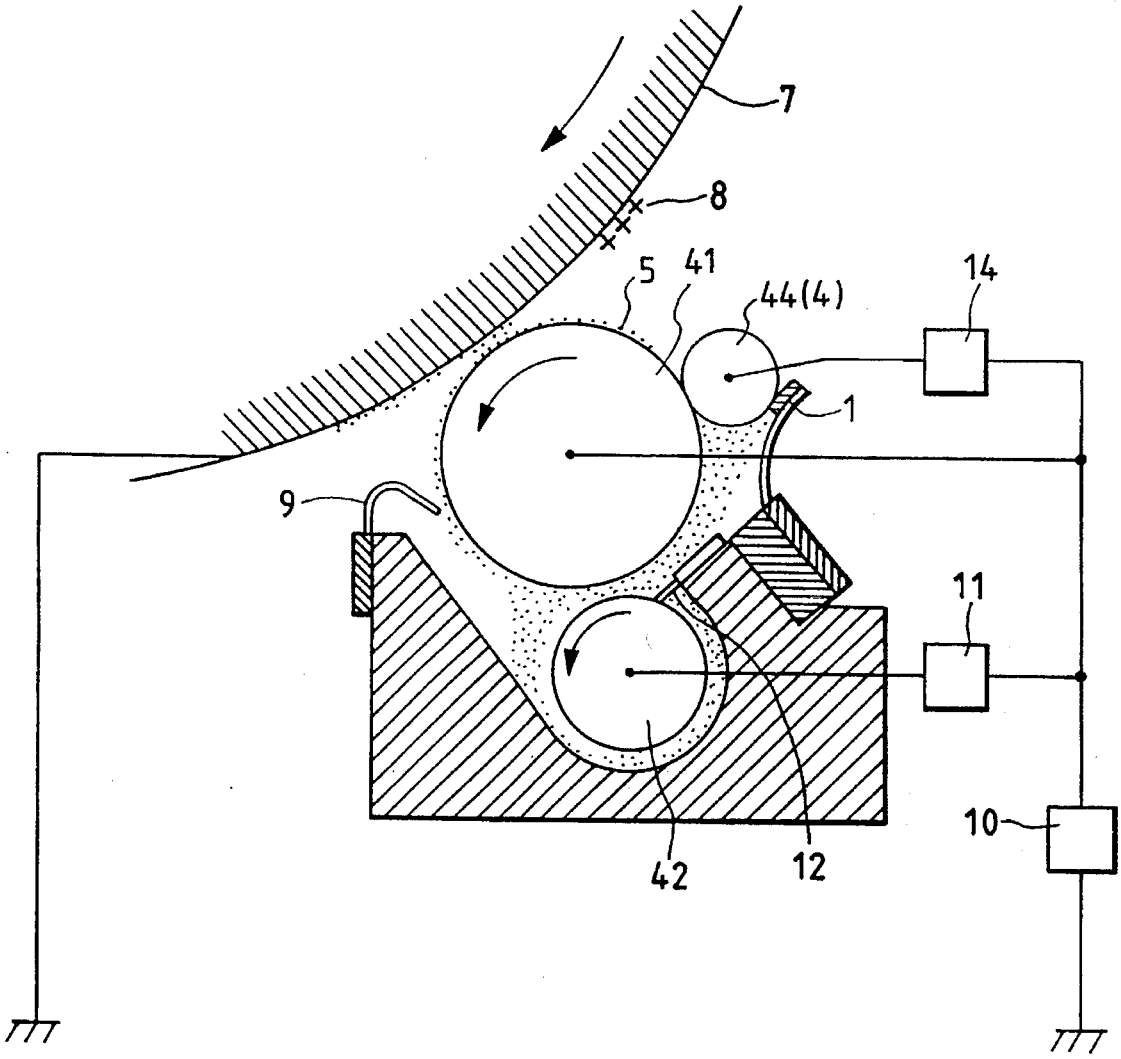
FIG. 5 is a schematic section view showing a developing device relating to Example 2.

In place of the blade-like layer forming member 6, a roll-like layer forming member 44 such as shown in FIG. 5 may be used.

The roll-like layer forming member 44 has a configuration in which the surface of an aluminum or stainless steel round bar of about 3 to 10 mmϕ is covered by conductive silicone rubber or EPDM rubber in the thickness of 0.5 to 5.0 mm so that the volume resistivity of the conductive rubber layer is set to be $10^3$ to $10^9$ Ωcm. The layer forming member 44 is contacted with the toner carrier 41 at a pressure of 20 to 100 gf/cm, and rotated so that its surface moves in the direction opposite to the moving direction of the surface of the toner carrier 41, and at a peripheral speed which is 0.1 to 3.0 times, preferably 0.5 to 1.5 times that of the toner carrier 41. An AC voltage to which a DC voltage is superposed or a DC voltage is applied from a power source 14 to the layer forming member 44 as a bias voltage between the member and the toner carrier 41. When a DC voltage having the polarity opposite to that of the toner on the carrier 41 is applied to the layer forming member 44, the toner on the carrier 41 is attracted to the surface of the layer forming member 44 by the electric field due to the DC voltage.

In the case where the roll-like layer forming member 44 is disposed, as shown in FIG. 5, the toner scraper 1 is disposed so as to be contacted with the layer forming member 44. The toner which is scraped off by the toner scraper 1 is returned into the developing device and reused in the development.

Hereinafter, the invention will be described in more detail by illustrating specific examples.

EXAMPLE 1

The example relates to a developing device in which the toner scraper 1 is applied to the peeling roll 43 as shown in FIG. 4. The developing device was installed in a test copying machine (test apparatus obtained by modifying FX6800), and then subjected to a print test for a long period under the following conditions.

i) Latent image holder 7: Negatively charging organic photosensitive drum ii) Process speed: 160 mm/sec iii) Toner carrier 41: Stainless steel roll of 24 mmϕ on which a phenol resin semiconductive layer ($10^6$ Ωcm) was formed, and which was rotated at 180 rpm.

iv) Toner supply member 42: Stainless steel pipe roll of 19 mmϕ which was provided with a plurality of openings, and which was rotated at 600 rpm.

v) Layer forming member 6: Stainless steel plate spring (SUS303) having a thickness of 0.12 mm, and one end to which EPDM rubber of 1 mm thickness was adhered. The contact pressure was about 120 gf/cm.

vi) Peeling roll 43: Stainless steel roll of 8 mmϕ having a surface covered with EPDM rubber ($10^5$ Ωcm) of a thickness of 2 mm. The roll was rotated at 430 rpm.

vii) Toner scraper 1: Stainless steel plate spring member (SUS303) of 304×12×0.08 mm to which EPDM rubber of 304×3×1 mm was adhered. The contact pressure was about 30 gf/cm.

viii) Gap between the latent image holder 7 and the toner carrier 41: about 200 μm ix) Interference amount (contact depth) between the peeling roll 43 and the toner carrier 41: about 300 μm x) Potential of a latent image on the holder 7: −100 V xi) Back potential of the holder 7: −350 V xii) Bias for development: DC −200 V to which AC 2,400 $V_{PP}$ (4 kHz) was superposed.

xiii) Bias of the peeling roll: DC +100 V to which AC 1,200 $V_{PP}$ (4 kHz) was superposed. The period of the AC voltage was synchronized with that of the bias for development.

xiv) Toner: Polyester nonmagnetic one-component color toner

As a result, even after a copy operation was repeated on about 60,000 sheets, the toner scraper conducted a uniform and excellent toner scraping, and the image hysteresis phenomenon did not occur in the copy images.

Figure 11:
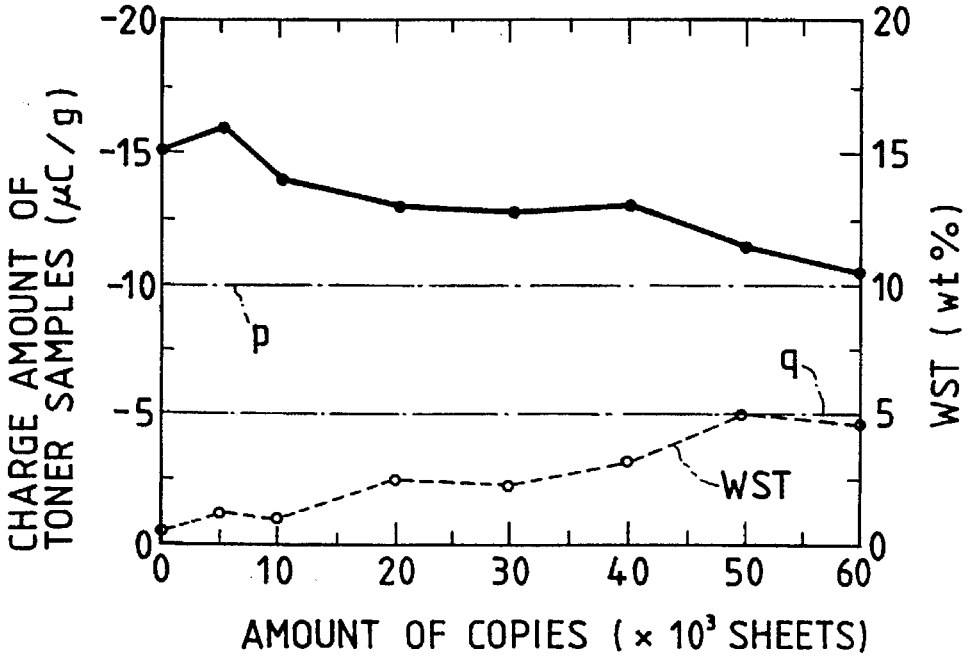
FIG. 11 is a graph showing measurement results of the toner charging property in Example 1.

In order to check the temporal change of the charging property of the toner, samples of the toner in the developing device were periodically collected during the print test of 60,000 sheets, and the charge amount of the toner samples and the content (WST) of the toner charged with the opposite polarity were measured by a charge spectrograph. The results are shown in FIG. 11. In the figure, a one-dot chain line p indicates the critical limit of the allowable range of the charging amount of the toner, and another one-dot chain line q indicates the critical limit of the allowable range of WST.

As apparent from the results of FIG. 11, it was confirmed that the reduction of the charging property of the toner due to the deterioration of the toner was very small.

EXAMPLE 2

The example relates to a developing device in which the toner scraper 1 is applied to the roll-like layer forming member 44 as shown in FIG. 5. The developing device was installed in the test copying machine, and then subjected to a running test for a long period under the same conditions as those of Example 1 except the followings.

i') Roll-like layer forming member 44: Stainless steel roll of 8 mm in diameter having a surface covered with EPDM rubber ($10^5$ Ωcm) of a thickness of 2 mm. The roll was rotated at 300 rpm, and the line pressure was 50 gf/cm.

ii') Toner scraper 1: Stainless steel plate spring member (SUS303) of 304×12×0.08 mm to which EPDM rubber of 304×3×1 mm was adhered. The contact pressure was about 30 gf/cm.

iii') Bias potential of the roll-like layer forming member: DC +100 V

A running test corresponding to copy operations of about 60,000 sheets was conducted with the result that the toner scraper conducted a uniform and excellent toner scraping.

Figure 12:
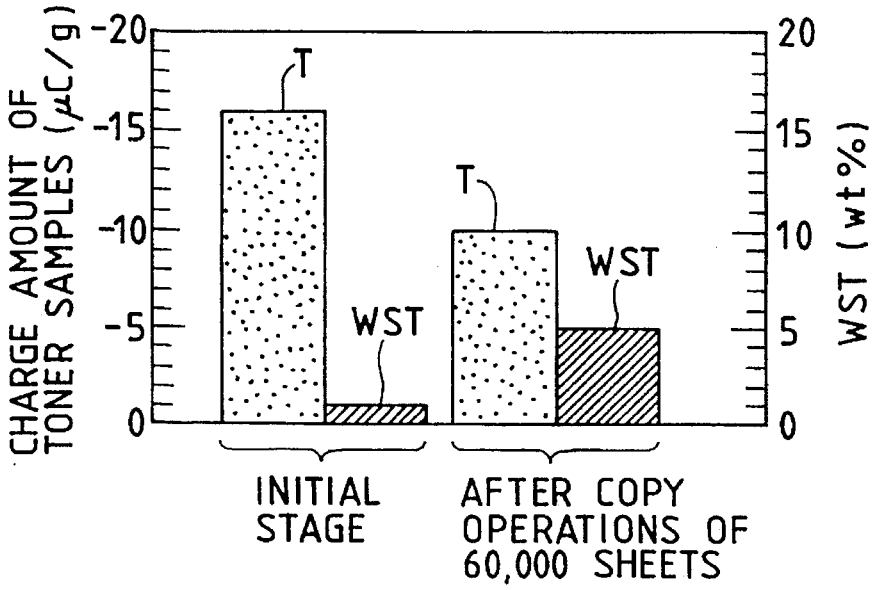
FIG. 12 is a graph showing measurement results of the toner charging property in Example 2.

The developing device was operated offline to conduct a running test corresponding to copy operations of about 60,000 sheets. The charge amount of the toner samples and the content (WST) of the toner charged with the opposite polarity were measured at the initial stage and after copy operations of 60,000 sheets by a charge spectrograph. The results are shown in FIG. 12. As apparent from the results, it was confirmed that the reduction of the charging property of the toner due to the deterioration of the toner was very small and that a toner thin film was uniformly formed.

EXAMPLE 3

Figure 6:
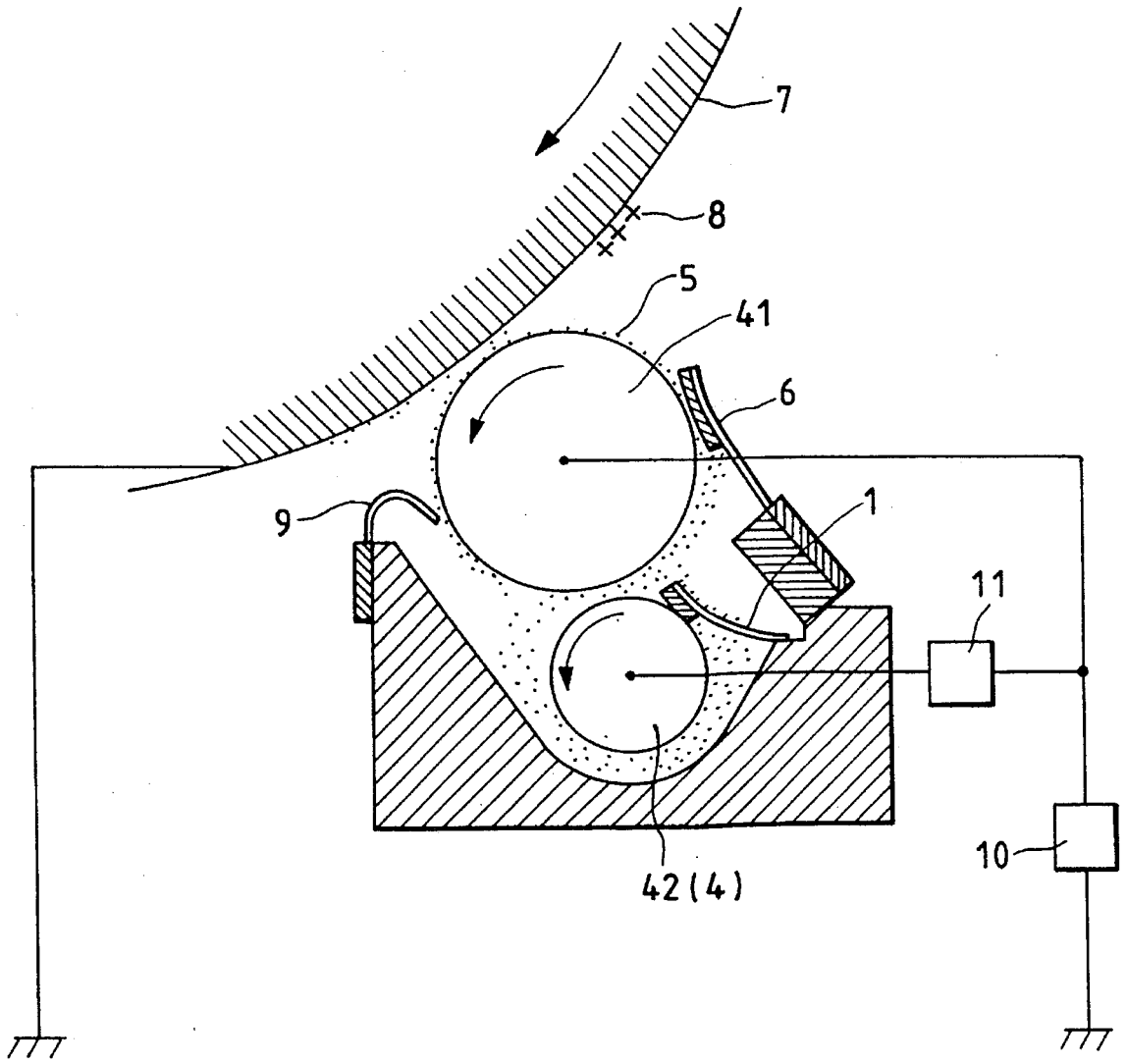
FIG. 6 is a schematic section view showing a developing device relating to Example 3.
Figure 7:
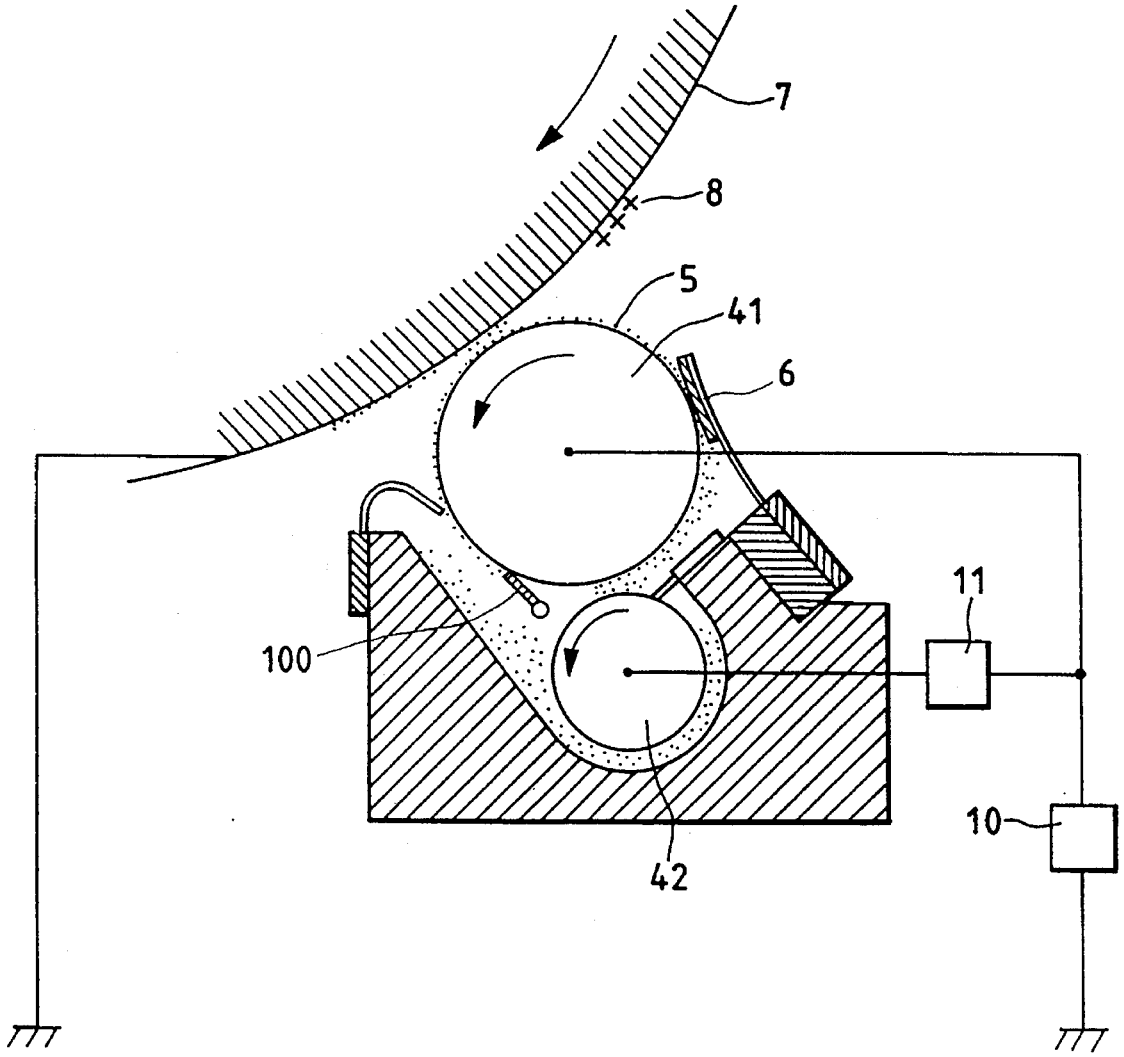
FIG. 7 PRIOR ART
FIG. 7 is a schematic section view showing a developing device to which a conventional toner scraper is applied.
Figure 8A:
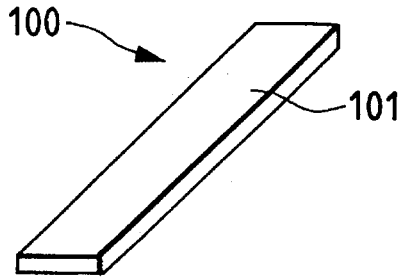
FIG. 8(a) PRIOR ART
FIGS. 8(*a*) and 8(*b*) are perspective views showing a typical example of a conventional toner scraper.
Figure 8B:
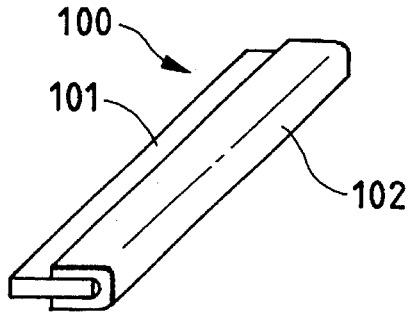
FIG. 8(b) PRIOR ART
Figure 9:
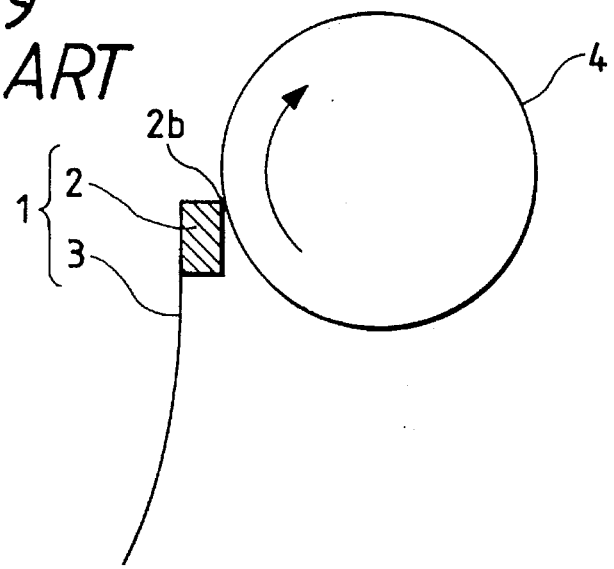
FIG. 9 PRIOR ART
FIG. 9 is a view illustrating a contact state of a conventional toner scraper.

The example relates to a developing device in which the toner scraper 1 is applied to the toner supply roll 42 as shown in FIG. 6. The developing device was installed in the test copying machine, and then subjected to a running test for a long period under the same conditions as those of Example 1 except the followings.

i") Toner supply roll 42: Same as the toner supply member of Example 1.

ii") Toner scraper 1: Stainless steel plate spring member (SUS303) of 300×10×0.10 mm to which EPDM rubber of 300×2×1 mm was adhered. The contact pressure was about 50 gf/cm.

A running test corresponding to copy operations of about 60,000 sheets was conducted with the result that the toner scraper conducted a uniform and excellent toner scraping.

Figure 13:
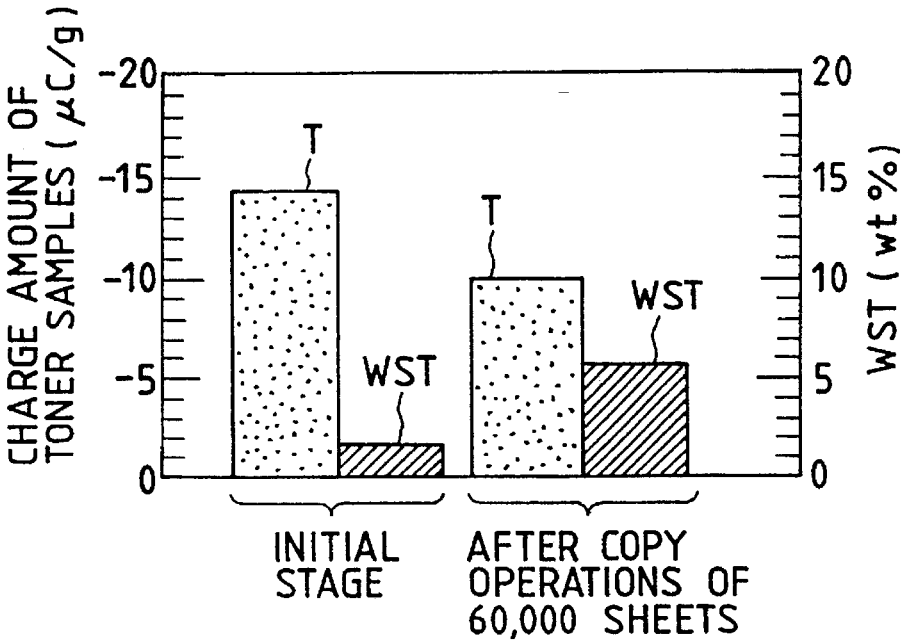
FIG. 13 is a graph showing measurement results of the toner charging property in Example 3.

In the same manner as Example 2, the developing device was operated offline to conduct a running test corresponding to copy operations of about 60,000 sheets. The measurements were conducted in the same manner as Example 2. The results are shown in FIG. 13. As apparent from the results, it was confirmed that the reduction of the charging property of the toner due to the deterioration of the toner was very small and that a toner thin film was uniformly formed.

Next, a test for the toner scraper 1 of the invention and the contact pressure thereof was conducted in the following manner.

Figure 14:
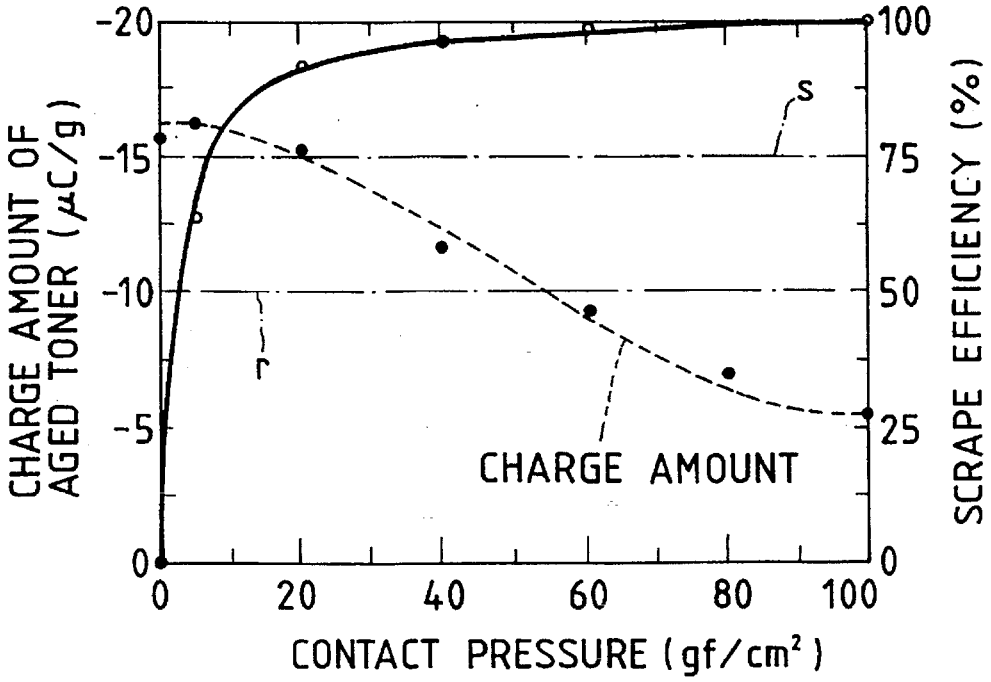
FIG. 14 is a graph of measurement results showing the relationship between the contact pressure of the toner scraper of the invention, and the toner scraper efficiency and the charge amount of an aged toner.

In the developing device of Example 1, while changing the contact pressure of the toner scraper 1, the toner scrape efficiency and the charge amount of an aged toner were measured. The toner scrape efficiency means the proportion of the toner scraped off by the toner scraper, and the aged toner is a toner to which a stress corresponding to copy operations of 10,000 sheets is applied by operating only the developing device. The results are shown in FIG. 14.

In the figure, a one-dot chain line r indicates the critical limit (−10 μC/g) of the allowable range of the charging amount of the aged toner. When the charging amount of the aged toner is smaller than −10 μC/g, fogging easily occurs. Another one-dot chain line s indicates the critical limit (75%) of the allowable range of the scrape efficiency. When the scrape efficiency is smaller than 75%, the efficiency of recovering the toner by the peeling roll 43 is lowered so that the toner remains to exist on the toner carrier 41 which passes through the development area, whereby the image hysteresis phenomenon is caused to easily occur.

From the above, the contact pressure of the toner scraper is required to be within the range of 5 to 50 gf/cm.

As described above, the toner scraper of the invention has a very simple structure which includes the rubber member and the plate spring member and can be produced at a low cost. Even when the contact pressure is relatively low (50 gf/cm or lower), the toner scraper can exert a uniform and stable contact on the rotation body which is disposed as a component of a developing device. The member to be contacted with the rotation body is a rubber member which is elastically supported, and the contact pressure is low. Therefore, the possibility of damaging the surface of the rotation body is reduced, and the surface of the rotation body is prevented from being abraded or deformed for a short period. Moreover, it is not required to increase the driving torque of the rotation body. Even in the case of a long period use, a stress applied to a toner is low and therefore also the deterioration of the toner is low.

When the toner scraper of the invention is applied to a developing device, it is possible to surely scrape off a toner for a long period so that problems due to the adhesion of the toner can be prevented from occurring. In the case where the scraper is applied to a toner carrier or a toner peeling member, for example, the image hysteresis phenomenon can be eliminated. In the case where the scraper is applied to a toner supply member, the supply of a toner to a toner carrier can be conducted more stably. In the case where the scraper is applied to a roll-like layer forming member, a toner supplied to a toner carrier can be formed into a layer more stably.

When a developing device to which the toner scraper of the invention is applied is used, therefore, the image formation of a higher quality can stably be conducted for a long period.

What is claimed is:

1. A developing apparatus in which an electrostatic latent image formed on a photosensitive body is developed by a toner held by toner carrying means, said developing apparatus comprising:

toner peeling means for removing toner from said toner carrying means; and a toner scraping means for removing toner from said toner peeling means, said toner scraping means including a rubber member having a pair of edges facing said toner peeling means and a plate spring member having a free end and a mounted end for elastically supporting said rubber member, wherein one edge of the pair of edges nearer to the mounted end side of said plate spring member contacts said toner peeling means, and the other edge of the pair of edges nearer to the free end side of said plate spring member is separated from said toner peeling means; and said toner peeling means is a roller rotating in a direction opposite to a rotating direction of said toner carrying means.

* * * * *

UNITED STATES PATENT AND TRADEMARK OFFICE

CERTIFICATE OF CORRECTION

PATENT NO. : 5,570,164

DATED : October 29, 1996

INVENTOR(S) : Mikio YAMAMOTO et al.

It is certified that error appears in the above-indentified patent and that said Letters Patent is hereby corrected as shown below:

Title page, Abstract, lines 1-15, should read as follows:
--A toner scraper includes a rubber member affixed to the free end of a cantilever mounted plate spring member such that only an edge portion of the rubber member that is upstream relative to the direction of rotation of a rotating member lightly contacts the surface of the rotating member to remove toner therefrom.--

Signed and Sealed this

Eighteenth Day of March, 1997

Bruce Lehman

*Attest:*

BRUCE LEHMAN

*Attesting Officer*

*Commissioner of Patents and Trademarks*